United States Patent [19]

Bawel

[11] Patent Number: 4,481,935

[45] Date of Patent: Nov. 13, 1984

[54] FLUE PIPE CONNECTION

[75] Inventor: Fred Bawel, Boonville, Ind.

[73] Assignee: Arkla Industries, Inc., Evansville, Ind.

[21] Appl. No.: 449,879

[22] Filed: Dec. 15, 1982

[51] Int. Cl.[3] ..... F23J 11/00

[52] U.S. Cl. ..... 126/307 R; 137/314; 285/13

[58] Field of Search ..... 126/307 R, 313, 314, 126/315, 110 R; 285/13, 14; 137/312, 313, 314

[56] References Cited

U.S. PATENT DOCUMENTS

| | | | |
|---|---|---|---|
| 226,074 | 3/1880 | Jackson | 285/13 |
| 393,381 | 11/1888 | McSweeney | 285/14 |
| 1,517,242 | 12/1924 | Lowrey | 285/14 |
| 1,746,775 | 2/1930 | Johnson et al. | 285/13 |
| 1,774,631 | 9/1930 | Boosey | 285/13 |
| 1,991,130 | 2/1935 | Warren | 285/14 |
| 2,382,579 | 8/1945 | Queirolo | 126/307 R |
| 2,471,708 | 5/1949 | White | 285/13 |
| 2,501,011 | 3/1950 | Smart | 126/307 R |
| 2,649,105 | 8/1953 | Stout | 285/13 |
| 4,082,322 | 4/1978 | Lever | 98/60 |
| 4,261,326 | 4/1981 | Ihlenfield | 126/110 R |

*Primary Examiner*—Daniel J. O'Connor
*Attorney, Agent, or Firm*—Cushman, Darby & Cushman

[57] ABSTRACT

Flue gases from fuel-fired appliances such as household gas furnaces contain water vapor which may form condensate on the walls of the external flue pipe leading from the appliance. The present invention provides a special flue pipe connection between the internal flue pipe and the external flue pipe. The connection accepts the lower end of the external flue pipe, directs condensate moving down the walls of the external flue pipe to a condensate drain outlet provided in the connection and passes flue gases from the internal flue pipe upwardly into the external flue pipe while isolating those gases from the condensate being drained. In the preferred construction the connection is a collar having an upwardly facing cylindrical recess into which the lower end of the external flue pipe fits and, within the recess, a short pipe section having a lower end connectable to the internal flue pipe and an upper end through which flue gases pass into the external flue pipe. Condensate moving down the wall of the external flue pipe passes into an annular trough located below the upper end of pipe section and formed by the wall of the recess, the exterior surface of the pipe section and an annular bottom wall. The condensate then flows out through the drain opening which is in communication with the interior of the trough.

4 Claims, 5 Drawing Figures

FLUE PIPE CONNECTION

This invention relates to fuel-fired appliances and in particular to the draining of condensate which may form in the flue gas conduits of appliances such as household gas-fired furnaces. More specifically the invention relates to a special connection of joint between flue gas conduit sections which permits downwardly moving condensate to be drained away while permitting flue gases to pass upwardly through the connection.

BACKGROUND

In recent years the heating efficiency of fuel-fired appliances such as household furnaces has been increased by extracting additional heat from the combustion gases before passing those gases into a flue external of the appliance. In the case of a gas-fired, forced-air furnace, for example, the combustion gases after passing through the usual heat exchanger cell, which also serves as part of a combustion chamber, are passed through one or more additional but non-fired heat exchanger cells and then into an external flue. Room air is forced past the exterior of all the exchangers so that heat exchange takes place through the metal walls of the exchangers. This heat exchange will typically reduce the temperature of the flue gases in the non-fired heat exchanger or recuperative cell to a level, for example 200° F., at which some of the water vapor in the flue gases will condense on the inner surface of the recuperative cell. A drain connection is provided in the recuperative cell to allow the condensate to pass to a permanent drain. A recuperative furnace of this type is disclosed in U.S. Pat. No. 4,261,326.

SUMMARY OF THE INVENTION

The present invention relates to the removal of condensate from flue gas conduits at a point downstream of the heat-extraction means of a fuel-fired appliance. For example, in a recuperative gas-fired furnace of the kind summarized above there is likely to be additional condensation in the external flue pipe leading from the furnace, this flue pipe being connected at its inlet end to the outlet end of an internal flue conduit section leading from the recuperative cell. As such condensate is acidic and corrosive as a result of impurities in the fuel, it is desirable to prevent the condensate from passing through a connection from which it might leak thereby damaging the appliance or the building structure.

According to the principles of the present invention, there is provided a special joint between upper and lower flue gas conduit sections which freely passes flue gases from the lower section to the upper section and which includes means for draining away condensate moving down the interior surfaces of the upper conduit section. The special joint may be formed by the ends of the conduit sections or it may include one or more components fitted to the ends of the conduit sections. In any case the draining means includes a generally annular wall cooperating with the inner surface of at least one of the conduit sections (usually the upper conduit section) to form a generally annular trough which is located to receive any condensate formed on and flowing down the inner surface of the upper conduit section, the trough including at least one drain passage for draining condensate by gravity from the trough in a generally radially outward direction to a location external of the conduit sections. The joint may include one or more connecting components which cooperate with the ends of both conduit sections. The connecting component or assembly includes the draining means so that the condensate drains away before reaching the lower conduit section thus isolating the seal between that conduit section and the collar and avoiding leakage of condensate at this location. The drained-away condensate can be disposed of in any suitable way.

In a recuperative gas-fired furnace of the type described the special joint has particular utility when provided between the flue conduit inside the furnace (i.e. a lower conduit section) and the external flue pipe (i.e. an upper conduit section). In this case the condensate which drains away from the joint is desirably merged by means of a conduit with condensate draining from the recuperative cell of the furnace. The reason for this is that a furnace of this kind includes a blower in the internal flue gas conduit for producing a negative pressure in the heat exchanger cells and a positive pressure upstream of the blower. The connection between the internal flue conduit and the external flue pipe is thus at positive flue gas pressure. Consequently the drain opening in the special connection of the present invention is at positive flue gas pressure and flue gas is likely to accompany condensate draining from the connection. By connecting the drain opening in the connection to the recuperative cell or to the condensate drain from that cell flue gas will be prevented from escaping to the surrounding atmosphere.

In a preferred form of joint there is a collar structure having an upper or outlet aperture connectable to an upper flue conduit section, a lower or inlet aperture connectable to a lower flue conduit section and an annular upwardly-facing trough between the inlet and outlet apertures for receiving condensate from the upper conduit section and for isolating such condensate from the joint or seal between the collar and the lower conduit section. A drain opening is provided in the trough and a hose or other conduit is connected to the drain opening for carrying away the condensate. The flue gas outlet aperture is formed by a cylindrical socket-like recess into which the lower end of the external flue pipe is inserted, the side wall of the socket being tapered downwardly and inwardly so as to provide a friction fit with the external flue pipe. The flue gas inlet aperture is formed by the lower end of a short vertical length of pipe of smaller diameter than the socket, the pipe projecting upwardly into and spaced from the side wall of the socket. The trough is formed by the outer surface of the upper portion of the pipe, the surface of the side wall of the socket and an annular bottom wall extending generally radially between these two surfaces. The drain opening is provided in this annular bottom wall. A peripheral radially, extending flange may be included as a means for attaching the collar to the horizontal upper wall of the appliance.

The collar can thus be viewed as being constructed of an outer pipe section having an open upper end for receiving the external flue pipe, an inner pipe section having an open upper end and a lower open end connectable to the internal fluid conduit, an annular wall joining the outer pipe section to the exterior of the inner pipe section at a location between the ends of the latter so as to form an annular condensate collection chamber around the inner pipe section and a drain opening placing the interior of the collection chamber in communication with the outside of the collar. Conveniently the entire collar is cast as an integral one-piece structure, although it can be constructed of separate parts joined together.

DETAILED DESCRIPTION

Figure 1:
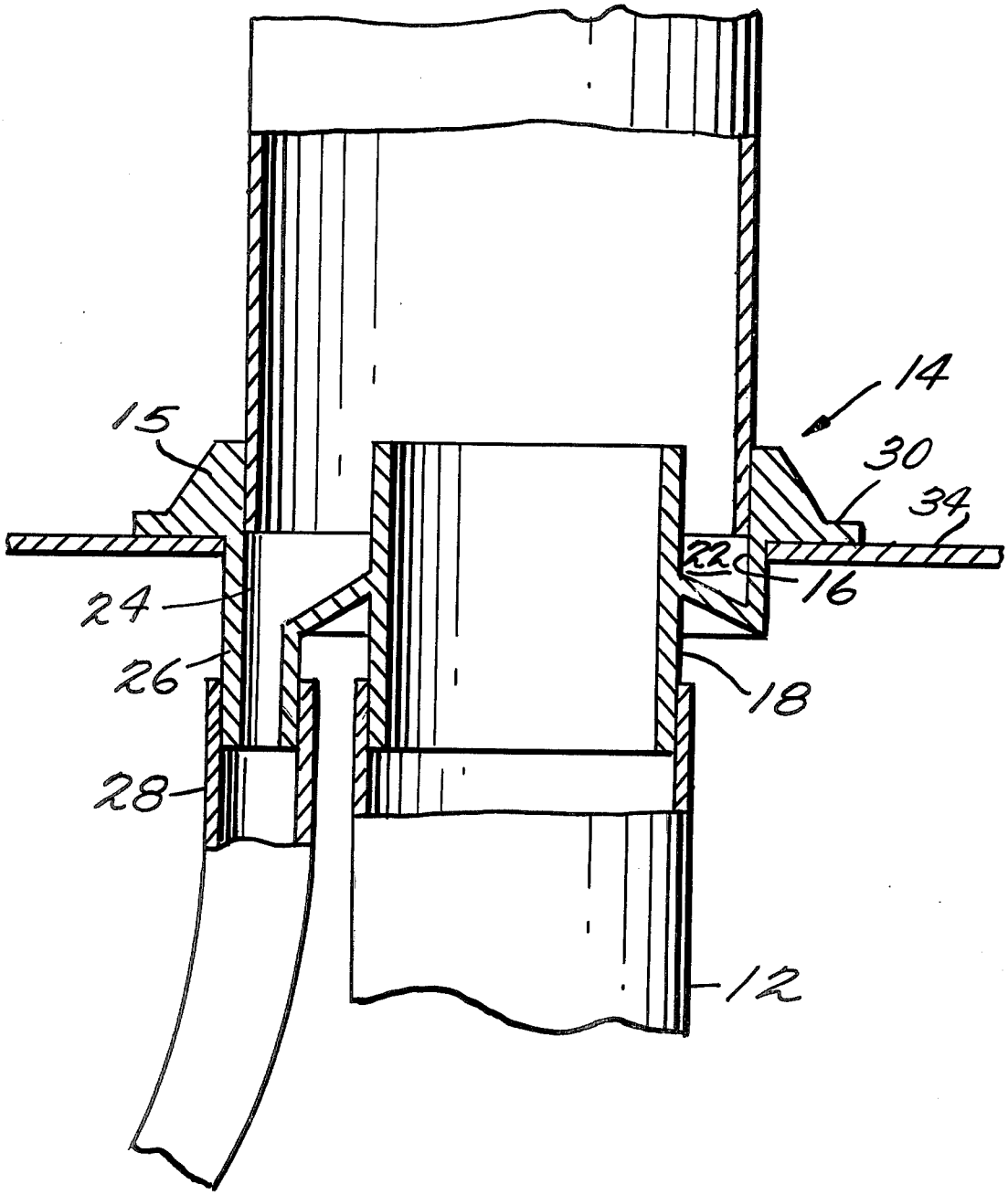
FIG. 1 is a vertical sectional view of a joint formed by a condensate drain collar embodying the principles of the present invention.
Figure 2:
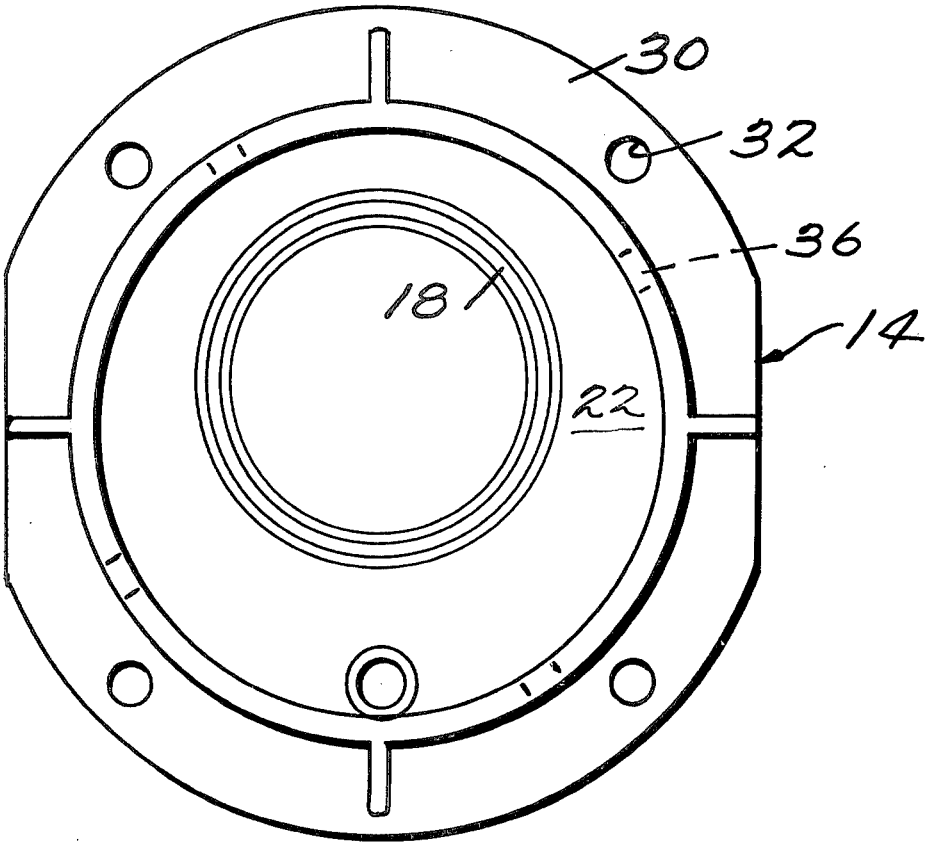
FIG. 2 is a plan view of the drain collar of FIG. 1.
Figure 3:
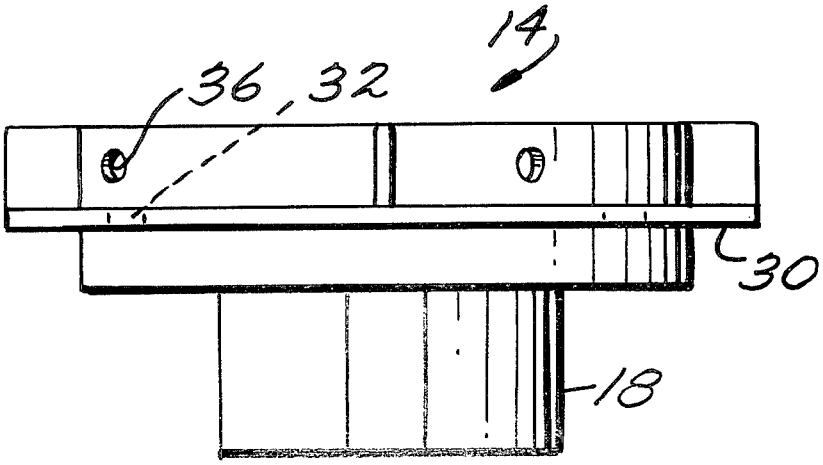
FIG. 3 is an elevational view of the drain collar of FIG. 1.

FIG. 1 illustrates a joint between an upper flue conduit section 10 and a lower flue conduit section 12 formed by a connecting collar 14 embodying the principles of the present invention. The collar 14 includes an outer pipe section 15 having an upwardly facing recess or socket which receives the lower end of the upper conduit section. The side wall 16 of the socket is frustoconical in that it inclines slightly downwardly and inwardly so as to form a snug fit around the upper conduit section 10. The upper end of the lower flue conduit section 12 fits over the tapered lower end of an inner pipe section 18 which is part of the collar 14. The upper end of the inner pipe 18 resides in the socket and is spaced from the socket side wall 16. A generally radial annular wall 20 connects the socket side wall 16 and the exterior of inner pipe 18 at a location between the ends of the latter. There is thus formed an annular condensate collection chamber or trough 22 between the socket side wall 16 and the exterior of the inner pipe 18, with the radial wall 20 defining the bottom wall of the trough 22.

Any condensate formed in the upper flue conduit section 10 and moving down the inner surface of that section will pass into this trough 22 and will then drain by gravity through a drain opening 24 in the bottom wall 20 of the trough 22. The drain opening 24 could alternatively be provided in the wall of the outer pipe section 15. In the illustrated embodiment the drain opening 24 is the upper end of a vertical pipe stub 26 and a flexible hose 28 is releasably connected to the lower end of the stub 26 to carry the condensate to a suitable location for disposal. The bottom wall 20 of the condensate trough 22 is inclined toward the drain opening 24 to facilitate flow of condensate out of the trough 22. As the upper end of the flue gas inlet pipe 18 is well above the bottom wall 20 of the condensate trough 22 and is radially spaced from the lower end of the upper flue section 10, flue gases passing upwardly through the joint are isolated from contact with the condensate. In addition, the seal between the upper flue section 10 and the collar 14, i.e. the contact area between flue section 10 and the trough side wall 16, is isolated from the condensate so that no leakage of condensate from the collar 14 will occur.

The collar 14 also includes a peripheral radial mounting flange 30, provided with bolt holes 32, to facilitate attachment of the collar 14 to a support structure such as the top wall 34 of a fuel-fired appliance. Radial holes 36 through the side wall 16 of the socket are provided to receive screws or bolts which aid in attaching the upper flue section 10 to the collar 14.

As illustrated in the drawings the collar 14 is a unitary cast structure. It may, if preferred, be constructed of its several parts connected together in a suitable manner.

Figure 4:
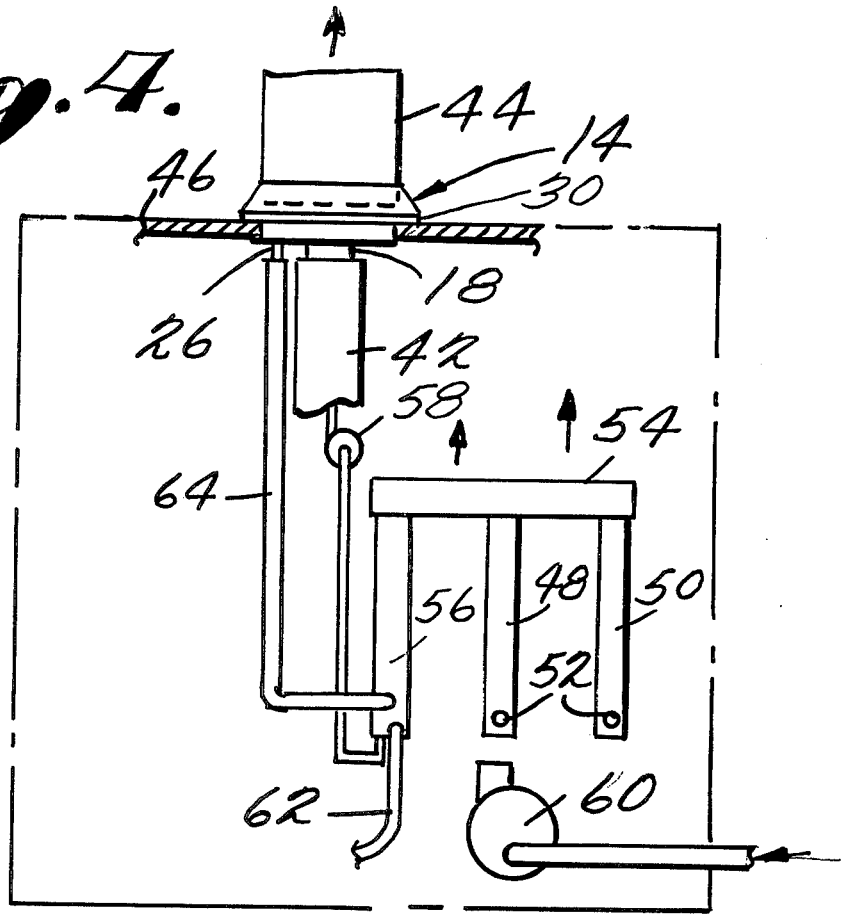
FIG. 4 is a schematic fragmentary view of a household gas-fired furnace having an internal flue conduit joined to an external flue pipe by the drain collar illustrated in FIG. 1.

FIG. 4 illustrates schematically a household gas-fired furnace 40 of the recuperative type described previously, with the condensate drain collar 14 of FIG. 1 installed between an internal flue gas conduit 42 and an external flue pipe 44. The conduit 42 and pipe 44 are connected to the collar 14 in the same manner as the conduit sections 10 and 12 in FIG. 1. The collar 14 is attached to the horizontal top wall 46 of the furnace casing 47 by bolts (not shown) passing through the collar flange 36. The furnace 40 includes two heat exchanger/combustion cells 48,50 each provided with a gas burner 52 which injects gas and air into the respective cell in the usual way. Combustion gases generated in the cells 48,50 pass upwardly into a plenum 54 and then downwardly through a non-fired recuperative heat exchanger cell 56. From the bottom of the cell 56 the gases pass upwardly through a blower 58 and into the internal flue gas conduit 42. A main blower 60 draws in household air and passes it over the outside of the cells 48,50 and 56 so as to be heated. The thus-heated air is then distributed to the rooms of the house by ducts (not shown). As explained previously heat exchange between flue gas in the recuperative heat exchanger cell 56 and the household air may reduce the temperature of the flue gas to a level such that water vapor will condense on the inner surfaces of the recuperative cell 56. It is conventional to connect a condensate drain tube 62 to the lower end of the recuperative cell 56 for draining away the condensate to a household drain.

As the temperature of the flue gas will drop still further in the external flue pipe 44, additional condensate may be formed in the latter. This additional condensate flows downwardly into the condensate trough 22 in the drain collar 14 and then out through the pipe stub 26 as described previously. In the embodiment of FIG. 4 a conduit such as a flexible hose 64 connects the pipe stub 26 with the interior of the recuperative heat exchanger cell 56 near the lower end thereof. Condensate draining through the drain hose 62 is thus a combination of condensate from the recuperative cell 56 and condensate from the external flue pipe 44.

Figure 5:
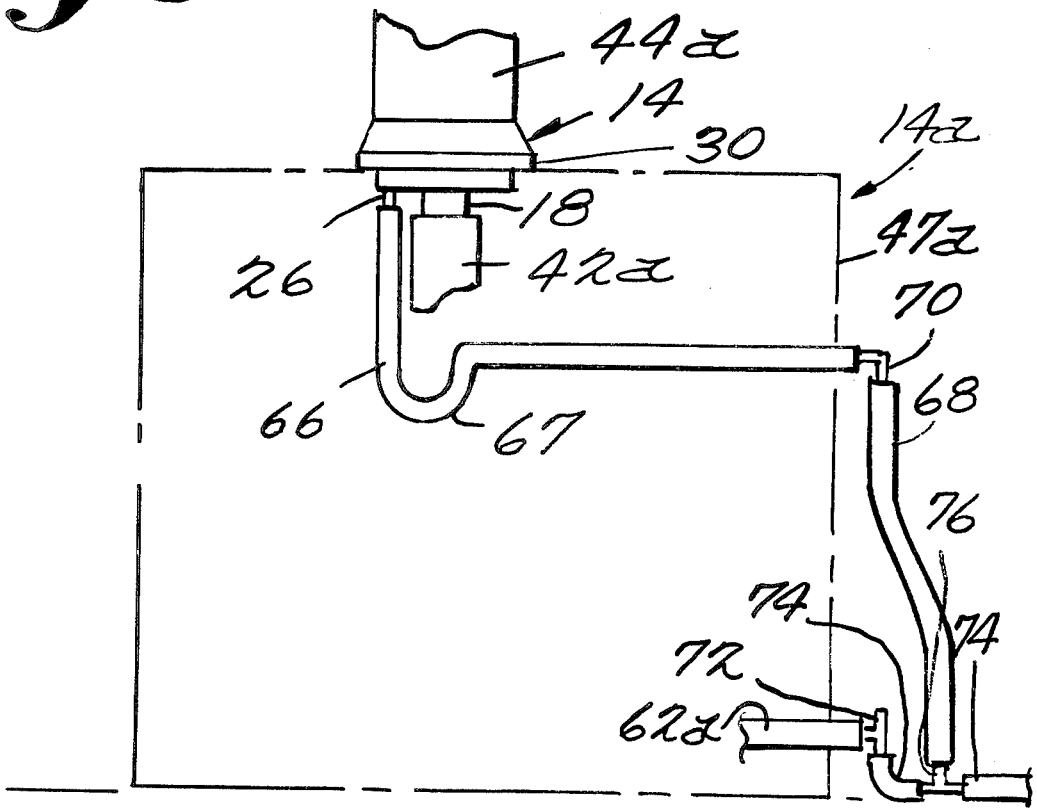
FIG. 5 is a schematic view of an existing household gas-fired furnace which has been retrofitted with the drain collar of FIG. 1.

FIG. 5 illustrates schematically an existing recuperative furnace **14*a* which has been retrofitted with the condensate drain collar 14 of FIG. 1 installed between the external flue pipe 44*a* and the internal flue conduit 42*a*. In this embodiment a conduit 66, containing a U-shaped trap portion 67, connects with the drain pipe 26 of the collar 14 and extends to the outside of the furnace casing 47*a* where it connects with the upper end of an external conduit 68 by means of a conventional fitting 70. The recuperative cell condensate line 62*a* passes to the outside of the furnace casing 47*a* where it connects via a tee 72 with a main drain hose 74. The upper end of the tee 72 is open to the atmosphere. The lower end of the flue pipe condensate hose 68 connects with the main drain hose 74 by means of a tee 76**.

What is claimed is:

1. In combination with a fuel-fired recuperative furnace having a non-fired recuperative heat exchanger cell and a condensate drain tube leading from said cell; a collar forming a joint between an upper external flue conduit section and a lower flue conduit section within the furnace and connected to said recuperative heat exchanger cell, said collar providing for draining away condensate which may form on the inner surface of the upper conduit section, said collar having an upwardly facing flue gas outlet aperture connected to the lower end of the upper external flue conduit section, a downwardly facing flue gas inlet aperture in communication with said outlet aperture and connected to the upper end of the lower flue conduit section, means between said inlet and outlet forming a condensate collection chamber for receiving condensate passing into the collar through the outlet aperture, said chamber isolating collected condensate from said inlet aperture and being provided with a condensate drain opening; and conduit means for merging condensate from said drain opening with condensate from said recuperative heat exchanger cell, said conduit means having an upper end connected to said condensate drain opening of said collar and having a lower end in communication with said drain tube which leads from said recuperative heat exchanger cell.

2. In combination with a fuel-fired recuperative furnace having a non-fired recuperative heat exchanger cell and a condensate drain tube leading from said cell; a collar for forming a joint between an upper external flue conduit section and a lower flue conduit section within the furnace and connected to said recuperative heat exchanger cell, said collar providing for draining away condensate which may form on and move downwardly the inner surface of the upper conduit section, said collar comprising: an outer pipe section having an upwardly facing open end for receiving therein the lower end of the upper external flue conduit section, an inner pipe section having an open upper end and an open lower end for fitting into the upper end of the lower flue conduit section; annular wall means joining said outer pipe section to the exterior of said inner pipe section at a location between the ends of the latter so as to form a condensate collection chamber between said pipe sections; and means defining a condensate drain opening located below the upper end of said inner pipe section; and conduit means for merging condensate from said drain opening with condensate from said recuperative heat exchanger cell, said conduit means having an upper end connected to said condensate drain opening of said collar and having a lower end in communication with said drain tube which leads from said recuperative heat exhanger cell.

3. In combination with a fuel-fired recuperative furnace having a non-fired recuperative heat exchanger cell and a condensate drain tube leading from said cell; a joint between the upper end of a lower flue pipe conduit within the furnace and connected to said recuperative heat exchanger cell and the lower end of an upper external flue pipe conduit, said joint comprising a connecting collar having an upwardly facing recess the side wall of which receives the lower end of the upper external conduit and seals with the periphery of the latter, said collar including an inner pipe section having an open upper end and an open lower end received into the upper end of the lower conduit and said collar further including an annular wall joining the side wall of said recess with the exterior of said inner pipe section at a location between the ends thereof thereby forming an annular chamber for collecting any condensate moving down the inner surface of the upper conduit, and means defining a drain opening at a location below the upper end of said inner pipe section; and conduit means for merging condensate from said drain opening with condensate from said recuperative heat exchanger cell, said conduit means having an upper end connected to said condensate drain opening of said collar and having a lower end in communication with said drain tube which leads from said recuperative heat exchanger cell.

4. In combination with a fuel-fired recuperative furnace having a non-fired recuperative heat exchanger cell and a condensate drain tube leading from said cell; a flue gas system for venting flue gas containing condensible vapors resulting from the combustion of a fuel, said system comprising an upper external flue gas conduit; a lower flue gas conduit within the furnace and connected to said recuperative heat exchanger cell; means forming a connection between the conduits such that flue gas can pass from the lower conduit into the upper conduit; and means including a generally annular wall cooperating with the inner surface of one of said conduits to form a generally annular trough which is located to receive any condensate formed on and flowing down the inner surface of the upper conduit, the trough including at least one drain passage for draining condensate by gravity from the trough in a generally radially outward direction; and conduit means for merging condensate from said drain passage with condensate from said recuperative heat exchanger cell, said conduit means having an upper end connected to said condensate drain passage of said trough and having a lower end in communication with said drain tube which leads from said recuperative heat exchanger.

* * * * *